US005689764A

United States Patent [19]

Fukuchi et al.

[11] Patent Number: 5,689,764

[45] Date of Patent: Nov. 18, 1997

[54] IMAGE FORMING APPARATUS AND DEVICE FOR DRIVING A CONTACT TYPE CHARGING MEMBER

[75] Inventors: Yutaka Fukuchi, Yokohama; Hidenobu Endoh, Tokyo, both of Japan

[73] Assignee: Ricoh Company, Ltd., Tokyo, Japan

[21] Appl. No.: 653,280

[22] Filed: May 24, 1996

[30] Foreign Application Priority Data

| | | | |
|---|---|---|---|
| May 24, 1995 | [JP] | Japan | 7-124719 |
| May 25, 1995 | [JP] | Japan | 7-126406 |
| Nov. 22, 1995 | [JP] | Japan | 7-304135 |

[51] Int. Cl.[6] ..... G03G 15/00

[52] U.S. Cl. ..... 399/75; 399/167; 399/174; 399/312

[58] Field of Search ..... 399/75, 115, 121, 399/167, 170, 174, 297, 312

[56] References Cited

U.S. PATENT DOCUMENTS

| | | | |
|---|---|---|---|
| 4,320,954 | 3/1982 | Ikeda et al. | 399/75 |
| 4,387,980 | 6/1983 | Ueno et al. | 399/174 |
| 5,124,759 | 6/1992 | Fukuchi et al. . | |

FOREIGN PATENT DOCUMENTS

| | | |
|---|---|---|
| 53-19837 | 2/1978 | Japan . |
| 63-177190 | 7/1988 | Japan . |
| 2-187773 | 7/1990 | Japan . |
| 5-61316 | 3/1993 | Japan . |
| 5-72836 | 3/1993 | Japan . |
| 5-100584 | 4/1993 | Japan . |
| 5-297781 | 11/1993 | Japan . |

*Primary Examiner*—Joan H. Pendegrass

*Attorney, Agent, or Firm*—Oblon, Spivak, McClelland, Maier & Neustadt, P.C.

[57] ABSTRACT

A device for driving a charge roller, charge belt, image transfer roller, image transfer belt or similar contact type charging member used to charge an image carrier of an image forming apparatus in contact with the image carrier. The charging member is driven by an exclusive motor independent of a motor for driving the image carrier. A drive gear and a driven gear are formed of metal and resin, respectively. A flywheel is mounted on a drive roller for causing the charging member to rotate. The drive side has greater rotation energy than the driven roller side. A flywheel is also mounted on the drive gear.

10 Claims, 14 Drawing Sheets

$\rho = 1.4 \times 10^{-3}$ kg/cm$^3$ $J = 1 \times 10^{-2}$ kg · cm$^2$ $\rho = 7.9 \times 10^{-3}$ kg/cm$^3$ $J = 1 \times 10^{-1}$ kg · cm$^2$

IMAGE FORMING APPARATUS AND DEVICE FOR DRIVING A CONTACT TYPE CHARGING MEMBER

BACKGROUND OF THE INVENTION

The present invention relates to an image forming apparatus of the type uniformly charging an image carrier by a charger, exposing the charged surface of the image carrier by an exposing device to thereby electrostatically form a latent image, developing the latent image by a developing device to thereby form a corresponding toner image, and transferring the toner image to a paper or similar recording medium by an image transfer device. More particularly, the present invention relates to an image forming apparatus in which the charger is implemented by a charge roller or belt contacting the image carrier, and the image transfer device is implemented by a transfer roller or belt suitably contacting the image carrier via the paper.

The above described type of image forming apparatus, i.e., so-called contact charge and/or contact image transfer type apparatus is implemented as, e.g., a copier, facsimile apparatus or printer. While the charge roller or belt is held in contact with a photoconductive drum or similar image carrier, a relatively low voltage is applied to the roller or belt in order to charge the drum. The transfer roller or belt causes a paper or similar recording medium to contact the drum carrying a toner image thereon. A relatively low voltage is also applied to the transfer roller or belt in order to transfer the toner image from the drum to the paper. In any case, each charging member, whether it be a roller or a belt, contacts the drum (including an intermediate transfer body in the form of a roller or a belt in the case of color image formation) either directly or indirectly via the paper. In this condition, the charging members are apt to scratch the drum or cause it to vibrate. In light of this, it has been customary to use an elastic material for the above charging members. Because the charging members are moved at substantially the same peripheral speed as the drum, they are driven by a main motor assigned to the drum or a motor assigned to a fixing device and paper feed device. A drive transmission mechanism connecting the charging members to the motor includes a number of gears and clutches.

However, when the charging members are driven by the main motor, the torque transmitted to the charging members by the transmission mechanism fluctuates due to vibration ascribable to the meshing of the gears. The fluctuation of the torque is transferred to the drum via the charging members and renders the rotation of the drum unstable. As a result, jitters including irregular charge and irregular exposure occurs on the surface of the drum, lowering image quality to a critical degree. To solve this problem, it is a common practice to affix a fly wheel to the drive shaft of the drum so as to increase the motion (rotation) inertia of the drum. It is possible to determine the optimal inertial mass so long as the drum (flywheel) is rotatable at a single preselected speed. However, if the drum is selectively rotatable at a plurality of different speeds, then the effect of the flywheel is deteriorated in the event of low speed rotation and fails to overcome impacts ascribable to clutches and solenoids. An extra flywheel may be added in order to increase the inertial mass. The extra flywheel, however, causes the oscillation components of the peripheral speed of the drum to concentrate at the low frequency side. Consequently, continuous irregularity in exposure occurs on the drum and lowers image quality. Further, the extra flywheel increases the overall weight and size of the apparatus.

Assume that the charging members are driven by the motor assigned to the fixing device and paper feed device. Then, because the loads of such devices vary due to papers sequentially passing therethrough, the variations of loads are transferred to the charging members via, e.g., speed reduction gears included in the transmission mechanism. Consequently, the rotation and movement of the charging members and therefore the rotation of the drum is caused to fluctuate, again resulting in irregular exposure on the drum.

SUMMARY OF THE INVENTION

It is therefore an object of the present invention to provide an image forming apparatus capable of reducing the transfer of vibration to an image carrier via a contact type charging member, and a device for driving the contact type charging member.

It is another object of the present invention to provide an image forming apparatus capable of reducing the transfer of vibration to a contact type charging member via a drive transmission mechanism, and a device for driving the contact type charging member.

In accordance with the present invention, an image forming apparatus has an image carrier for forming an image thereon. A first motor causes the image carrier to rotate. A contact type charging member charges the image carrier in contact therewith. A driven gear causes the charging member to rotate. A drive gear causes the driven gear to rotate in direct or indirect mesh therewith. A second motor independent of the first motor drives the charging means.

Also, in accordance with the present invention, an image forming apparatus has an image carrier. An image forming unit forms a toner image on the image carrier. A medium feed device feeds a paper or similar recording medium to the image carrier. A contact type charging member transfers the toner image from the image carrier to the medium. A conveying device conveys the medium carrying the toner image thereon. A first motor drives the medium feed device and conveying device. A second motor independent of the first motor causes the image carrier and charging member to rotate.

Further, in accordance with the present invention, an image forming apparatus has an image carrier. A motor causes the image carrier to rotate. A contact type charging member charges the image carrier by selectively contacting it. A moving mechanism moves the charging membeer between an operative position where the charging member contacts the image carrier and an inoperative position where it does not contact the image carrier. A drive transmission line includes a first driven gear for causing the charging member to rotate, and a first drive gear for causing the driven gear to rotate in direct or indirect mesh with the driven gear. A clutch drive line includes a second driven gear for causing the moving mechanism to rotate, and a second drive gear for causing the second driven gear to rotate in direct or indirect mesh with the second driven gear.

Furthermore, in accordance with the present invention, a device for driving a contact type charging member which charges the image carrier of an image forming apparatus in contact with the image carrier has a driven gear for causing the charging member to rotate. A drive gear causes the driven gear to rotate in direct or indirect mesh therewith. A driving device causes the drive gear to rotate. The drive gear and driven gear are formed of metal and resin, respectively.

Moreover, in accordance with the present invention, a device for driving a contact type charging member which charges the image carrier of an image forming apparatus in contact with the image carrier has a drive roller for causing the charging member to rotate. A driving device causes a gear affixed to the drive roller to rotate. A flywheel is mounted on one end of the drive roller, whereby the driving side has greater rotation energy than the driven roller side.

In addition, in accordance with the present invention, a device for driving a contact type charging member which charges the image carrier of an image forming apparatus in contact with the image carrier has a driven gear for causing the charging member to rotate. A drive gear causes the driven gear to rotate in direct or indirect mesh therewith. A driving device causes the drive gear to rotate. A flywheel is mounted on the drive gear.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
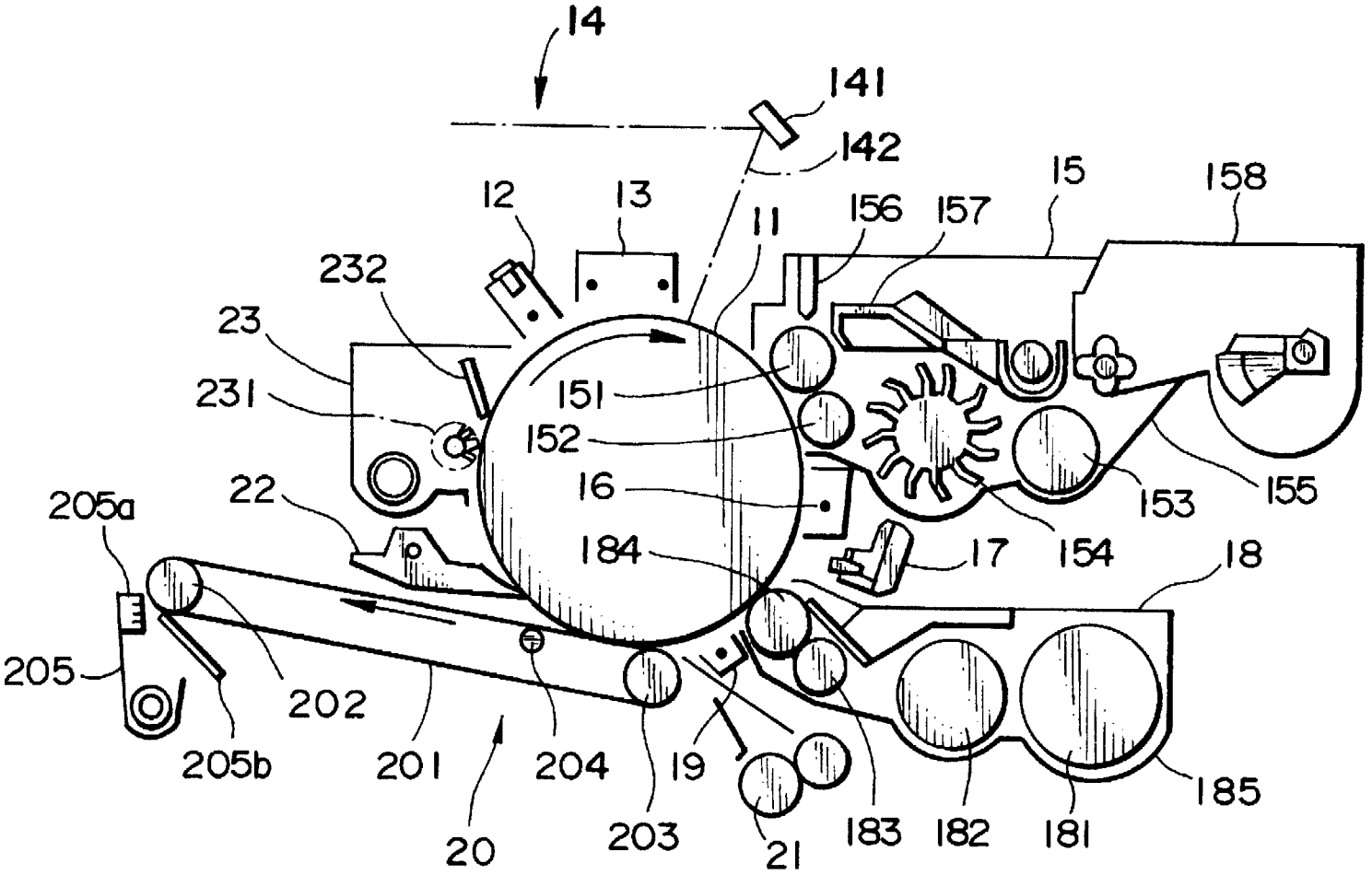
FIG. 1 is a fragmentary horizontal section of an image forming apparatus to which the present invention is applicable and implemented as a bicolor copier.

Referring to FIG. 1 of the drawings, an image forming apparatus to which the present invention is applicable is shown and implemented as a copier having a bicolor copying capability by way of example. As shown, the copier has a photoconductive drum or image carrier 11 driven by a main motor. A discharging device 12 is made up of a discharge lamp and a discharger. While the drum 11 is in rotation, the discharging device 12 dissipates the charge of, or discharges, the drum 11 by illuminating it. As a result, a reference surface potential between 0 V and −100 V is set up on the drum 11. Then, a first charging device or charger 13 uniformly charges the surface of the drum 11 to a potential of about −850 V. A first exposing device or writing unit 14 includes a line driver for receiving digital image data (black image data) representative of a document from an apparatus, not shown. A laser driver also included in the exposing device 14 amplifies the received image data. The image data are implemented as multi-level signal having eight bits for a pixel. The laser driver energizes a laser diode in accordance with the image data fed from the line driver.

A laser beam issuing from the laser diode is deflected by a polygonal mirror or deflector, transmitted through an f-theta lens, sequentially reflected by a first mirror, a second mirror and a third mirror 141, and then incident to the drum 11. In the portion of the drum 11 to which the laser beam 142 from the mirror 141 is incident (image portion), the surface potential varies to 0 V to −100 V, i.e., a latent image representative of a black image component is electrostatically formed on the drum 11. In this sense, the charger 13 and first writing unit 14 constitute a latent image forming device.

A first developing device 15 deposits black toner on the image portion of the drum 11 and thereby transforms the latent image to a corresponding black toner image. Specifically, the developing device 15 has developing rollers 151 and 152, an agitator roller 153, and a paddle 154. During the course of development, the rollers 151, 152 and 153 and paddle 154 are rotated by a driving device. The agitator roller 153 and paddle 154 convey a developer implemented as a black toner and carrier mixture stored in a casing 155, while agitating it. The developing roller 151 accommodates magnets therein. When the developer is conveyed by the paddle 154 to the developing roller 151, the roller 151 magnetically causes the developer to deposit thereon and conveys it while in rotation. A doctor blade 156 regulates the amount of the developer deposited on the roller 151. The developer on the roller 151 is passed through between the drum 11 and the rollers 151 and 152, returned to the casing 155, and again agitated and conveyed by the agitator roller 153 and paddle 154. On the other hand, the developer scraped off by the doctor blade 156 is dropped into the casing 155 by way of a separator 157. This part of the developer is also agitated and conveyed by the agitator roller 153 and paddle 154.

The developer brought to between the drum 11 and the developing rollers 151 and 152 develops the latent image formed on the drum 11. A toner replenishing section 158 replenishes fresh toner into the developer existing in the casing 155. A bias voltage of about −600 V is applied from a power source to the rollers 151 and 152. As a result, the toner of the developer is deposited on the image portion of the drum 11. However, the toner is not deposited on the other portion or non-image portion of the drum 11 whose potential is maintained at about −850 V.

The charging of the drum 11 by the charger 13 (first charging step), the exposure of the drum 11 by the first writing unit 14 (first exposing step) and the development of the latent image by the first developing device 15 (first developing step) are effected only when a bicolor mode or a black-and-white mode is selected on an operation panel, not shown. When a monocolor (red/blue) mode is selected, the charger 13, writing unit 14 and developing device 15 are rendered inoperative, so that the above consecutive steps are not executed.

Subsequently, the drum 11 is charged by a second charging device or charger 16 (second charging step), formed with a latent image by a second writing unit or exposing device 17 (second exposing step), and subjected to development by a second developing device 18 (second developing step). These steps are effected only when the bicolor mode or the monocolor (red/blue) mode is selected. In the black-and-white mode, the charger 16, writing unit 17 and developing device 18 are rendered inoperative, so that the black toner image on the drum 11 is brought to an image transfer position alone.

Specifically, in the bicolor mode or the monocolor mode, the charger 6 charges the drum 11 to the previously mentioned surface potential of about −850 V. The writing unit 17, like the writing unit 14, has a line driver for receiving digital color, e.g., red or blue image data from the apparatus, not shown, and a laser driver for amplifying the input image signal. Again, the digital color image data are implemented as a multilevel signal having eight bits for a pixel. The laser driver energizes a laser diode in accordance with the image signal fed from the line driver.

A laser beam issuing from the above laser diode is deflected by the polygonal mirror or deflector, transmitted through the f-theta lens, sequentially reflected by the mirrors, and then incident to the drum 11. In the portion of the drum 11 to which the laser beam from the writing unit 17 is incident (image portion), the surface potential varies to 0 V to −100 V, i.e., a latent image representative of a red or blue image component is electrostatically formed on the drum 11. In this sense, the charger 16 and second writing unit 18 also constitute a latent image forming device.

The second developing device 18 deposits red or blue toner on the image portion of the drum 11 and thereby transforms the latent image to a corresponding red or blue toner image. Specifically, the developing device 18 has agitator rollers 181 and 182, a scoop roller 183, and a developing roller 184. During the course of development, the rollers 181–184 are rotated by a driving device to circulate a developer or red or blue toner and carrier mixture stored in a casing 185, while agitating it. The red or blue toner is transferred from the developing roller 184 to the drum 11 so as to transform the latent image to a corresponding red or blue toner image.

A bias voltage of about −750V is applied from a power source to the developing roller 184. The bias voltage causes the color toner to deposit on the image portion of the drum 11. However, the color toner does not deposit on the other portion or non-image portion of the drum 11.

The part of the drum 11 moved away from the developing device 18 is discharged by a pretransfer discharger 19. Then, an image transfer device 20 transfers the toner image to a paper or similar recording medium. Specifically, the paper is fed from a paper feed device to a registration roller pair 21. The registration roller pair 21 drives the paper toward the image transfer device 20 at such a timing that the leading edge of the paper meets the leading edge of the toner image carried on the drum 11.

The image transfer device 20 has a belt 201, a drive roller 202 and a driven roller 203 over which the belt 201 is passed, a bias roller 204 contacting the inner surface or rear of the belt 201, and a belt cleaner 205. The drive roller 202 is connected to a motor via gears and rotated thereby, although not shown specifically. A belt moving mechanism, not shown, moves the belt 201 into contact with the drum 11 when the above motor is energized or moves it out of contact with the drum 11 when the motor is deenergized.

When the paper driven by the registration roller pair 21 arrives at the image transfer device 20, a bias voltage opposite in polarity to the black or color toner image is applied from a high-tension power source, not shown, to the bias roller 204. At the nip between the belt 201 and the bias roller 204, a charge opposite in polarity to the toner image is deposited on the paper via the bias roller 204 and belt 201. Consequently, the toner image is transferred from the drum 11 to the paper.

The bias applied to the belt 201 via the bias roller 204 causes the belt 201 to electrostatically retain the paper thereon. The belt 201 conveys the belt while in rotation. After the image transfer, the paper is electrostatically separated from the drum 11 or separated by a separator 22 if not electrostatically separated. The belt 201 conveys the paper toward a fixing device, not shown.

At the position where the drive roller 202 is located, the paper is separated from the belt 201 on the basis of curvature and the elasticity of the paper. The fixing device fixes the toner image on the paper by heat and pressure. Finally, the paper or copy is driven out of the copier. After the separation of the paper from the belt 201, the belt cleaner 205 removes the toner remaining on the belt 201 with a cleaning brush **205*a* and a cleaning blade 205*b*. Likewise, a drum cleaner 23 removes the toner remaining on the drum 11 with a cleaning brush 231 and a cleaning blade 232. This prepares the drum 11** for the next image forming cycle.

Figure 2:
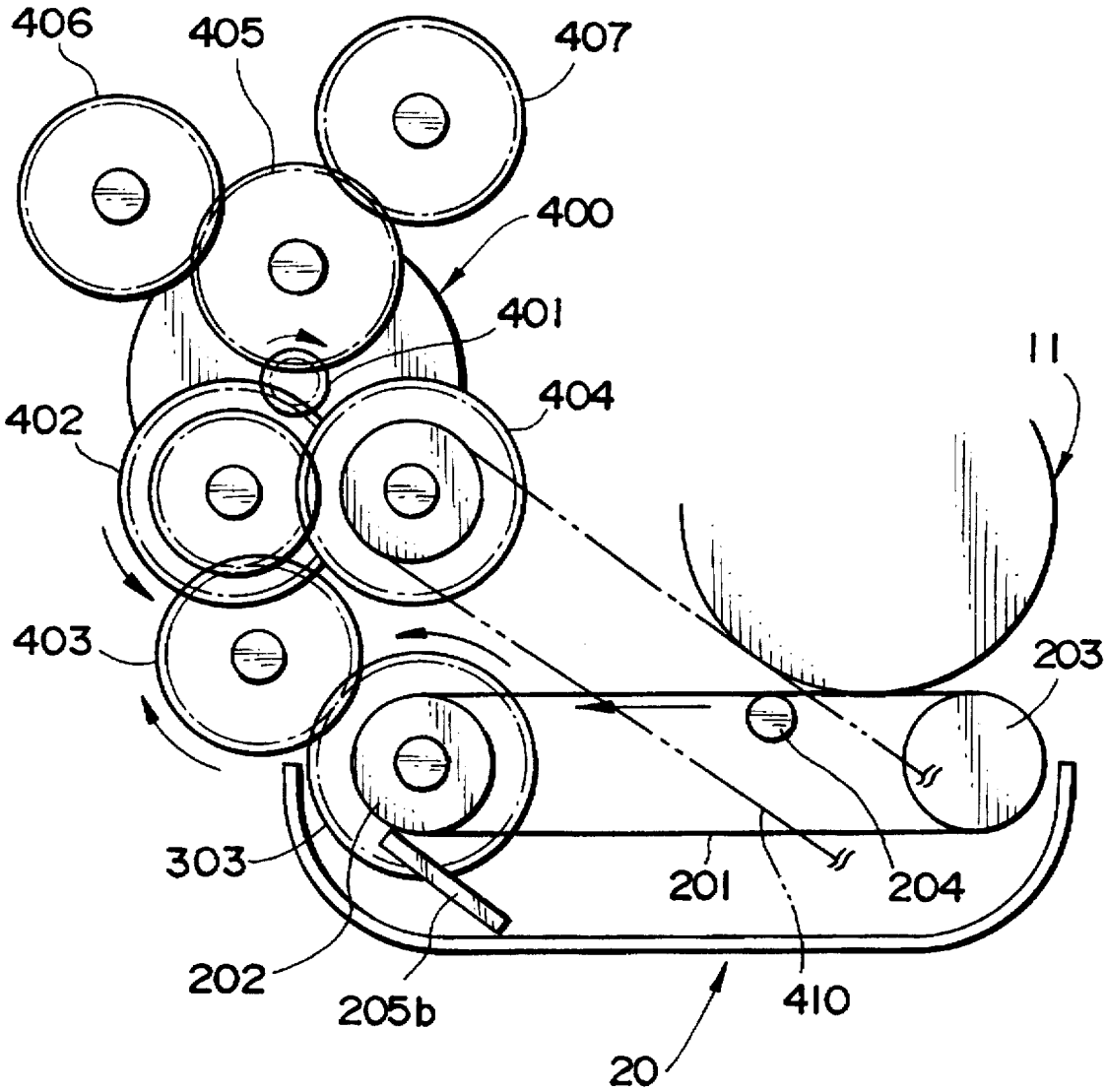
FIG. 2 is a side elevation showing a main drive line included in the copier.

FIG. 2 shows a drive line for driving the drum 11, registration roller pair 21, drive roller 202 and so forth. As shown, a gear 407 is held in mesh with an intermediate gear 405 in order to drive the developing device (rollers and so forth) and drum 11 via drive transmission lines, not shown. A gear 406 is held in mesh with the intermediate gear 405 in order to drive the fixing device (heat roller) and a paper discharge device (rollers) via transmission lines, not shown. A gear 404 is held in mesh with an intermediate gear 402 in order to drive the paper feed device (pick-up roller, conveyor roller and registration roller pair) via a transmission line including a timing belt 410. A gear 403 is held in mesh with the intermediate gear 402 in order to drive the image transfer device 20. The paper feed device includes a clutch, not shown, for beginning and ending the transport of a paper. The clutch is repeatedly coupled and uncoupled during the course of operation of the copier. The reference numerals 400 and 401 designate the main motor and its output shaft, respectively.

Hereinafter will be described the problems with the copier having the above construction, particularly the drive line shown in FIG. 2. A clutch, not shown, is affixed to one of the registration roller pair 21. When the clutch is coupled and uncoupled, its vibration is transferred to the belt 201 via the timing belt 410, gear or timing pulley 404, gear 402, gear 403, and gear 303. As a result, the running speed of the belt 201 varies. When the belt 201 is in contact with the drum 11, the vibration oft he belt 201 is transferred even to the drum 11 and causes the rotation speed of the drum 11 to vary.

Figures 3A, 3B, 3C:
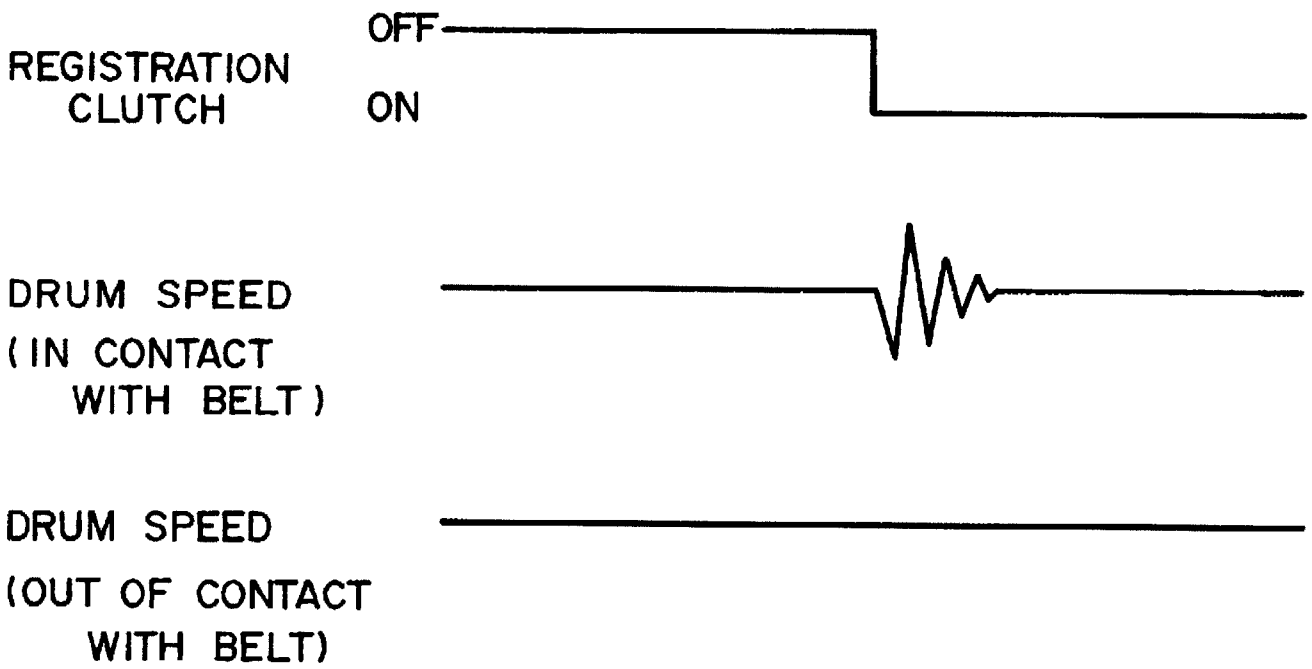
FIGS. 3A–3C are charts showing how the rotation speed of a photoconductive drum varies in association with the ON/OFF timing of a registration clutch included in the drive line of FIG. 2.

Specifically, FIG. 3A shows the ON/OFF timing of the clutch affixed to the registration roller 21. The rotation speed of the drum 11 varies as shown in FIG. 3B when the belt 201 is held in contact with the drum 11, or varies as shown in FIG. 3C when the belt 201 is spaced from the drum 11.

Experiments showed that when the belt 201 is released from the drum 11 by the previously mentioned belt moving mechanism, the rotation speed of the drum 11 does not vary at all (FIG. 3C). This means that if the belt 201 does not vibrate, then the rotation speed of the drum 11 does not vary.

Figure 4:
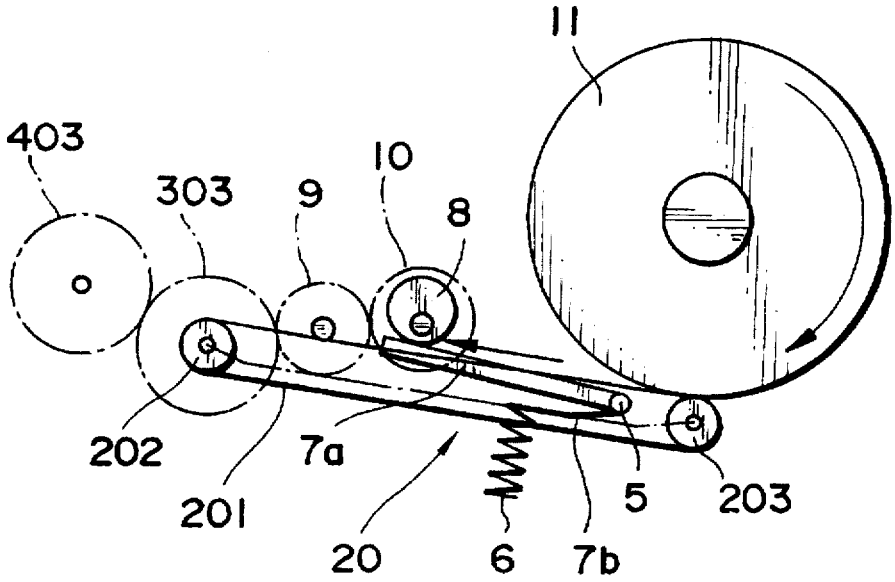
FIGS. 4 and 5 are side elevations respectively showing a transfer belt in a position contacting the drum and a position released from the drum.

While the copier is out of operation, the belt 201 is spaced from the drum 11. Should the belt 201 be continuously held in contact with the drum 11, the plastics of the belt 201 would be transferred to the drum 11 and would thereby lower image quality. As shown in FIG. 4, a clutch drive gear 10 is operatively connected to a driven gear 303 by an intermediate gear 9. The gear 10 is affixed to the input shaft of a half-rotation electromagnetic spring clutch. In this condition, the input shaft of the half-rotation clutch is driven by the clutch drive gear 10. A cam 8 is affixed to the output shaft of the half-rotation clutch. When the clutch is energized, it couples the input shaft to the output shaft until the output shaft, i.e., the cam 8 makes a half rotation. Then, the clutch uncouples the input shaft from the output shaft. In this manner, the output shaft or cam 8 makes a half rotation when current is fed to the clutch once.

Figure 5:
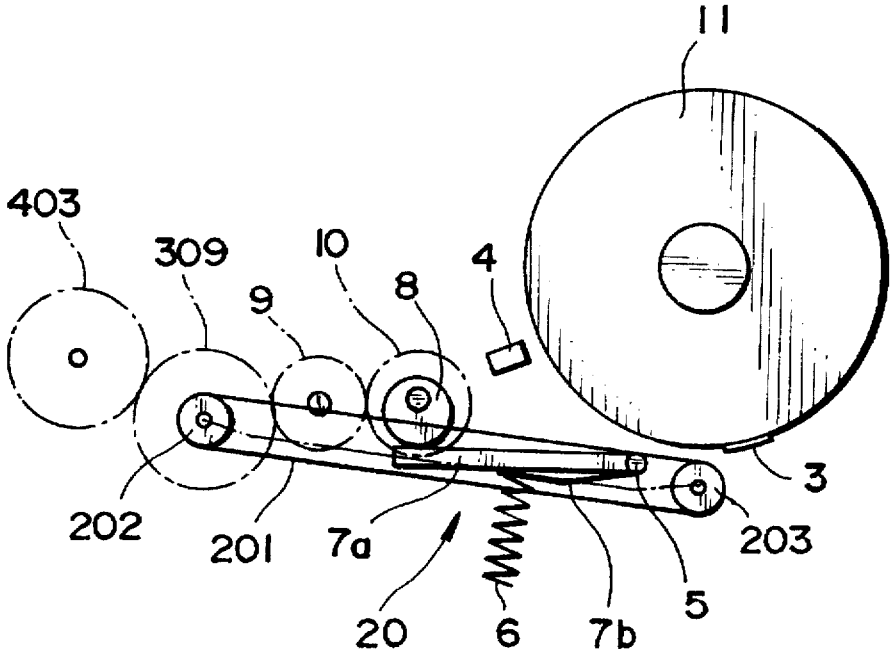

For example, when current is fed to the clutch held in the condition shown in FIG. 4, the cam 8 makes a half rotation in the clockwise direction. As shown in FIG. 5, the cam 8 causes a lever 7*a* to rotate counterclockwise about a shaft 5. As a result, a lever 7*b* configured integrally with the lever 7*a* is rotated counterclockwise, compressing a compression coil spring 6. An arm supporting the shaft of the driven roller 203 is rotatable about it and connected to the lever 7*b*. Consequently, the arm is also rotated counterclockwise and releases the belt 201 from the drum 11, as shown in FIG. 5.

When current is again fed to the clutch in the condition shown in FIG. 5, the cam 8 makes another half rotation. As a result, the lever 7*b* (as well as the roller 203, arm and lever 7*b*) is rotated clockwise due to the action of the coil spring 6 until the belt 201 again contacts the drum 11, as shown in FIG. 4.

It is to be noted that a toner pattern 3 (FIG. 5) is formed on the drum 11 for the purpose of sensing a toner density. During the course of copying operation, the belt 201 is released from the drum 11 until the toner pattern 3 moves away from the belt 201 so as not to scrape it off. The toner pattern is sensed by a photosensor 4.

Assume that exposure for writing a latent image on the drum 11 is started just after the toner pattern 3 has been formed on the drum 11 in order to reduce the first copying time, i.e., the interval between the operation of a print key and the discharge of the first paper or copy. Then, the toner pattern 3 will reach the driven roller 203 during the exposure. In light of this, the half-rotation spring clutch is energized after the toner pattern 3 has moved away from the drive roller 203, thereby causing the belt 201 to contact the drum 11. However, the resulting vibration of the clutch is transferred to the drive gear 303 via the intermediate gear or idler gear 9. As a result, the vibration of the idler gear 9 is transferred to the drum 11 via the drive roller 202 and belt 201. This causes jitters including irregular density and displacement to occur in the latent image.

Preferred embodiments of the image forming apparatus in accordance with the present invention will be described hereinafter.

1st Embodiment

Figure 6:
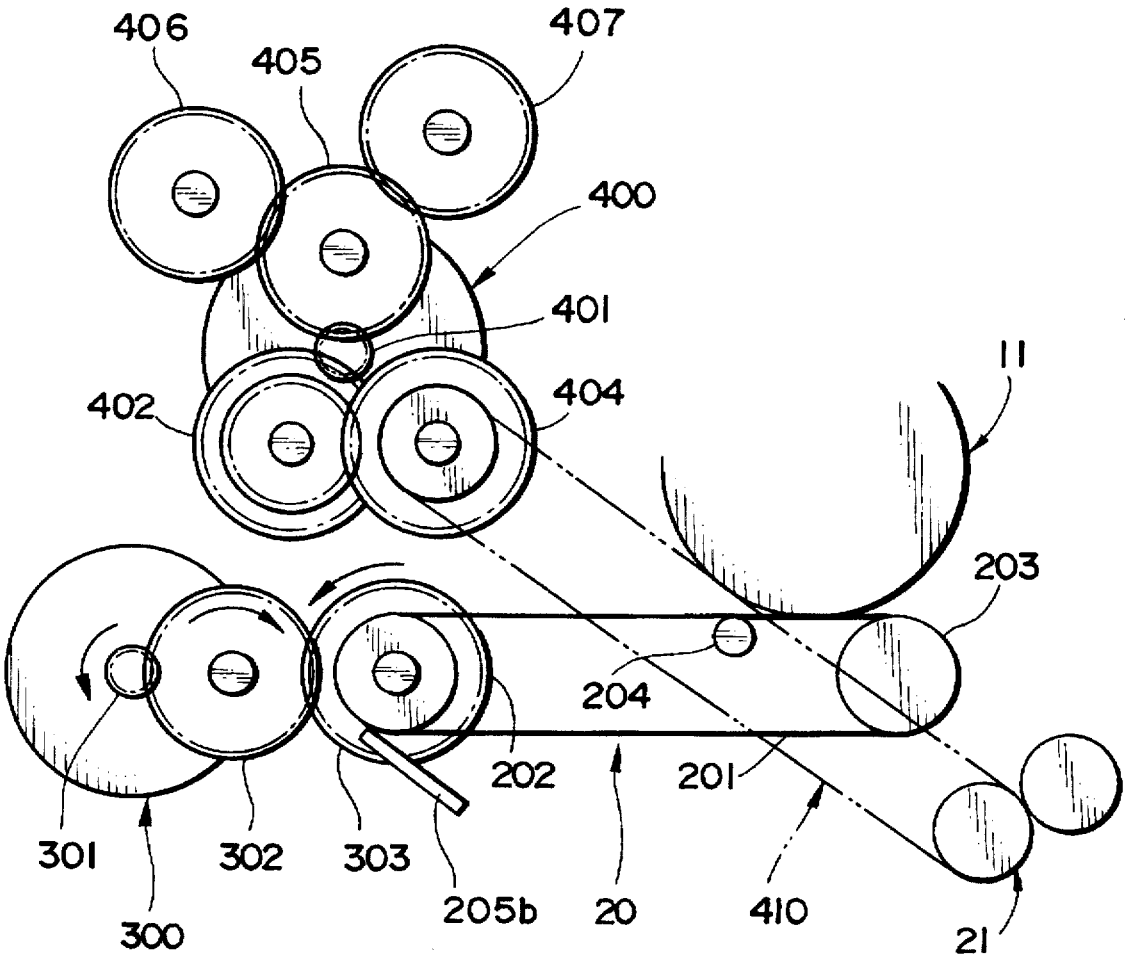
FIG. 6 is a side elevation showing a drive line representative of a first embodiment of the present invention.

Referring to FIG. 6, a belt drive line representative of a first embodiment is shown and applied to the copier shown in FIG. 1. As shown, the driven gear 303 affixed to the shaft of the drive roller 202 is held in mesh with an intermediate gear or speed reduction gear 302. The reduction gear 302 is held in mesh with a pinion gear 301 mounted on the output shaft of an electric motor 300. The gear 302 has thirty-six teeth and rotates at a speed of 142.6 rpm. The gear 303 has thirty teeth and rotates at a speed of 171.6 rpm. The main motor 400 drives the developing device and drum 11 via the gear 407, drives the device and paper discharge device via the gear 406, and drives the paper feed device via the gear 404, as in the arrangement shown in FIG. 2. The clutch included in the paper feed device is repeatedly coupled and uncoupled during the course of copying operation, as stated earlier. Although the loads and rotation speeds of the motor 400 and gears connected thereto vary due to the coupling and uncoupling of the above clutch, the variations are not transferred to the drive roller 202 over which the belt 201 is passed.

As stated above, the illustrative embodiment assigns an exclusive motor 300 to the belt 201 and thereby frees the belt 201 from the influence of variations in the loads and rotation speeds of the fixing device, paper feed device, and other units. Therefore, even when a flywheel is added to the drum 11, it is possible to reduce the inertial mass of the drum 11.

2nd Embodiment

Figure 7:
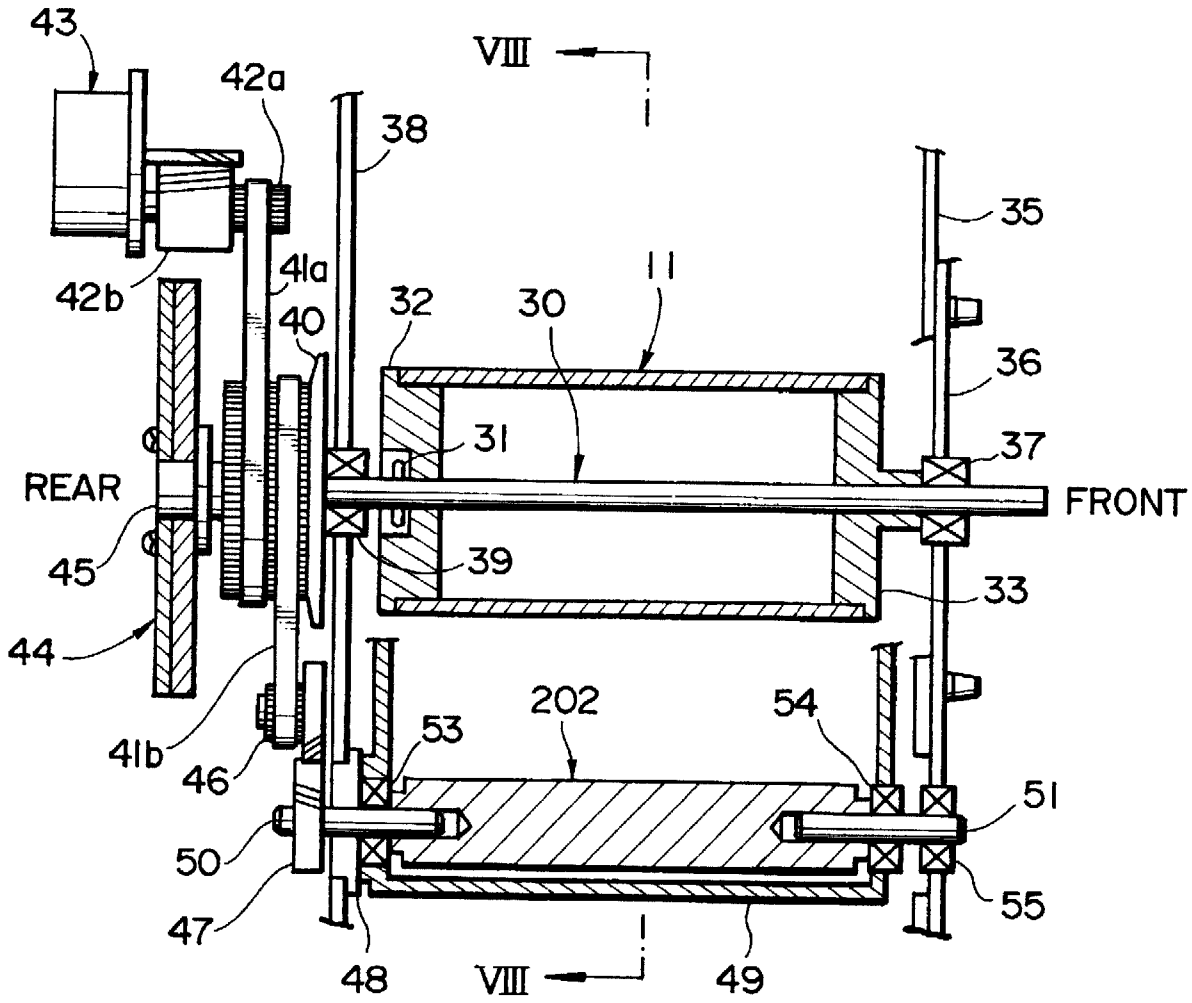
FIG. 7 is a section along line VII—VII of FIG. 8, showing a drive line representative of a second embodiment of the present invention.
Figure 8:
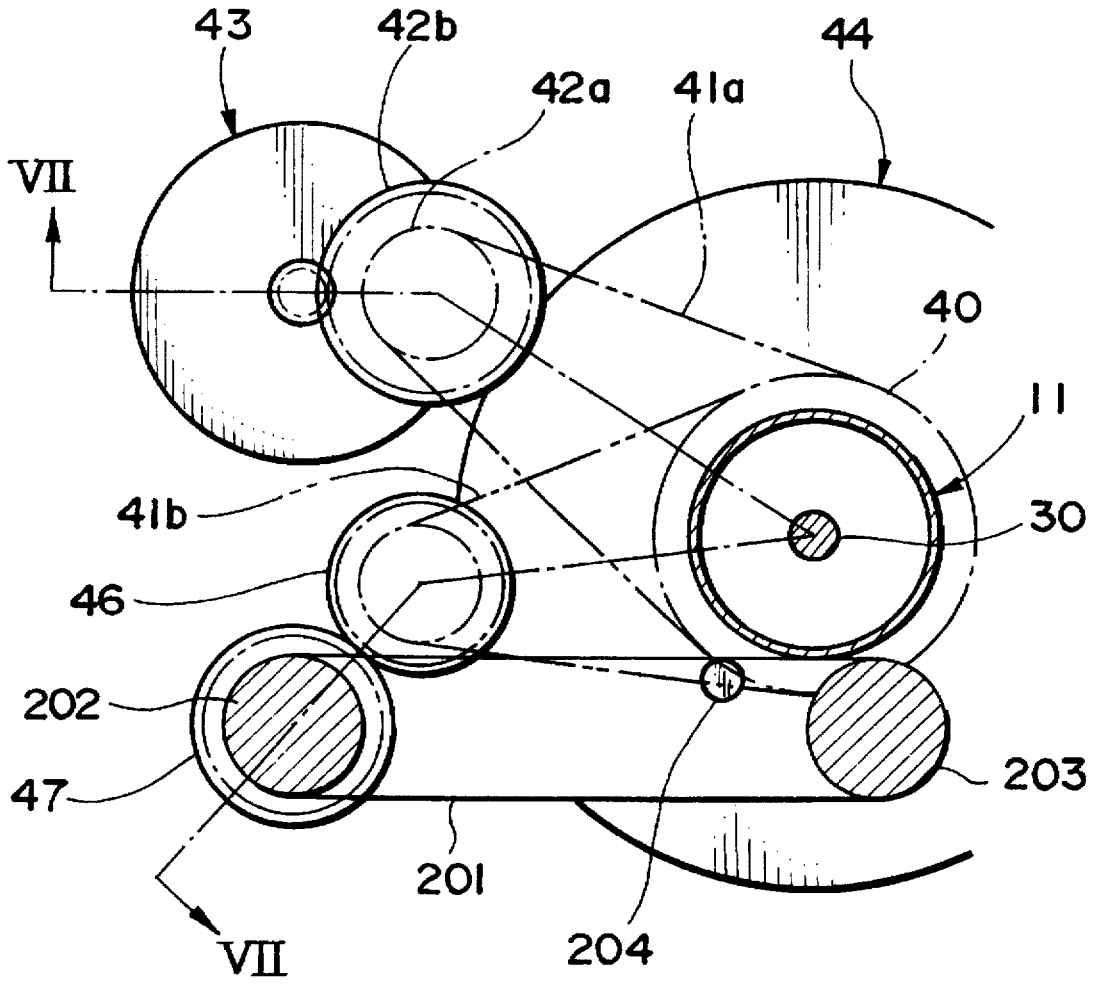
FIG. 8 is a section along line VIII—VIII of FIG. 7.

FIGS. 7 and 8 show a belt drive line representative of a second embodiment and also applied to the copier of FIG. 1. FIG. 8 is a section along line VII—VII of FIG. 8 while FIG. 8 is a section along lime VIII—VIII of FIG. 7. As shown in FIG. 7, a pin 31 is press fitted in a shaft 30 journalled to opposite side walls of the copier body. The drum 11 is supported by a flange 33 affixed to the pin 31 and another flange 33. Specifically, a positioning plate 36 is mounted on a front wall 35 included in the copier body. The shaft 30 is journalled to the front wall 35 via a bearing 37 at one end and journalled to a rear wall 38 via a bearing 39. A timing pulley 40 is affixed to the shaft 30 and is the driven gear of the drum 11. A timing belt 41*a* is passed over the timing pulley 40 and a drive timing pulley 42*a*. The timing pulley 42*a* and a speed reduction gear 42*b* are implemented as a single molding of resin. A motor 43 drives the drum 11 via the reduction gear 42*b*. A flywheel 44 is fastened to a flange 45 by screws while the flange 45 is affixed to the shaft 30.

A timing belt 41*b* is passed over the timing pulley 40 and a timing pulley 46. A gear is formed integrally with the timing pulley 46 as a molding of resin. Torque is transmitted from the gear of the pulley 46 to a gear 47. The gear 47 is press fitted in a shaft 50 or affixed thereto via a retainer. The shaft 50 is press fitted in the transfer drive roller 202 or engaged therewith end to end. A shaft 51 is connected to the roller 202 in the same manner as the shaft 50. The shaft 50 is journalled to a casing 49 included in the image transfer unit via a bearing 53. Likewise, the shaft 51 is journalled to the casing 49 via a bearing 54. The shaft 51 is journalled to the positioning plate 36 via a bearing 55 while the shaft 50 is journalled to the wall 38 via a flange 48. In this configuration, the drive section of the image transfer unit is positioned.

As shown in FIG. 8, the motor 43 drives only the drum 11 and image transfer device 20. The motor 43 causes the reduction gear 42*b* to rotate clockwise. The rotation of the gear 42*b* is transmitted to the timing pulley 40 via the timing pulley 42*a* with the result that the drum 11 is also rotated clockwise. The flywheel 44 is affixed to the shaft 30. The flywheel 44 cuts variations in load ascribable to the cleaning blade 232 (FIG. 1) and gap rollers, not shown, contacting the drum 11, and impacts ascribable to the leading edges of papers hitting against the drum 11. The gap rollers are held in contact with opposite ends of the drum 11 in order to position the developing device 15 and drum 11. The stable driving force free from irregularity is transmitted from the timing belt **41*b* to the driven gear 47 via the timing pulley 46 rotating clockwise and gear. As a result, the drive roller 202 rotating counterclockwise causes the belt 201 to rotate counterclockwise in cooperation with the driven roller 203. Further, the drive line shown in FIG. 8** is independent of the drive lines assigned to the paper feed system, fixing system and developing system and each involving the respective impact and variation in load.

Figure 9A:
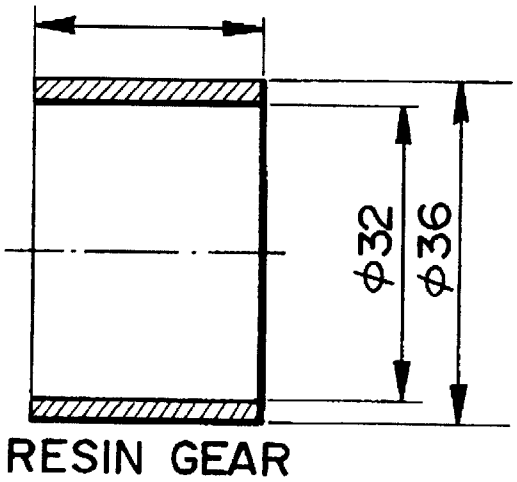
FIG. 9A shows a gear included in a timing pulley shown in FIG. 7 and formed of plastics and provided with specific dimensions.
Figure 9B:
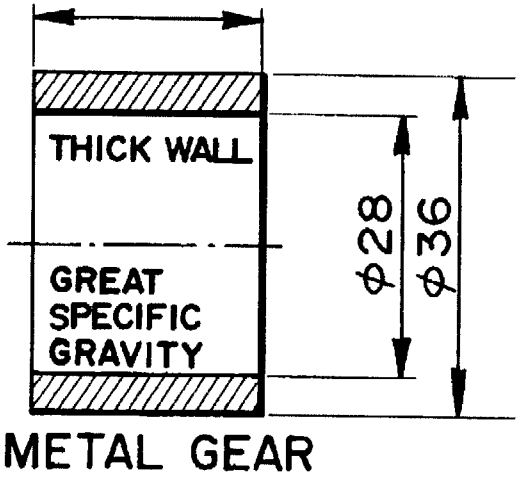
FIG. 9B shows the gear of the timing pulley formed of sintered metal and provided with other specific dimensions.

In the illustrative embodiment, the timing pulley 46 is made of iron-based sintered metal. Let this timing pulley 46 be compared with a timing pulley formed of plastics. Assume that the gear portion of the pulley 46 is implemented as a hollow cylinder having a tooth width of 12 mm and an outside diameter of 36 mm. Then, as shown in FIG. 9A, the pulley 46 formed of plastics has a moment of inertia J which is 0.01 kg·cm$^2$. On the other hand, as shown in FIG. 9B, the pulley 46 formed of sintered metal has a moment of inertia J which is 0.1 kg·cm$^2$ and ten times as great as the moment particular to the plastics pulley. This is because the metal pulley 46 has a greater specific gravity and can be made thicker than the plastics pulley 46.

The flywheel 44 has a moment of inertia J of 44 kg·cm$^2$ (thickness t of 2.9 mm and a diameter of 210 mm) and rotates at a speed of 40 rpm. The timing pulley 46 rotates at a speed of 200 rpm. The ratio of the plastics pulley 46 to the flywheel 44 as to rotary motion energy is produced by:

$$[\tfrac{1}{2}J(\text{plastics gear})\omega^2]/[\tfrac{1}{2}J(\text{flywheel})\omega^2]\times 100=0.55\%$$

By contrast, the ratio of the metal pulley 46 to the flywheel 44 as to rotation motion energy is 5%, as produced by a similar equation. It will be seen that the gear formed of iron-based sintered metal successfully reduces the variation in the rotation of the drive roller 202.

Figure 10A:
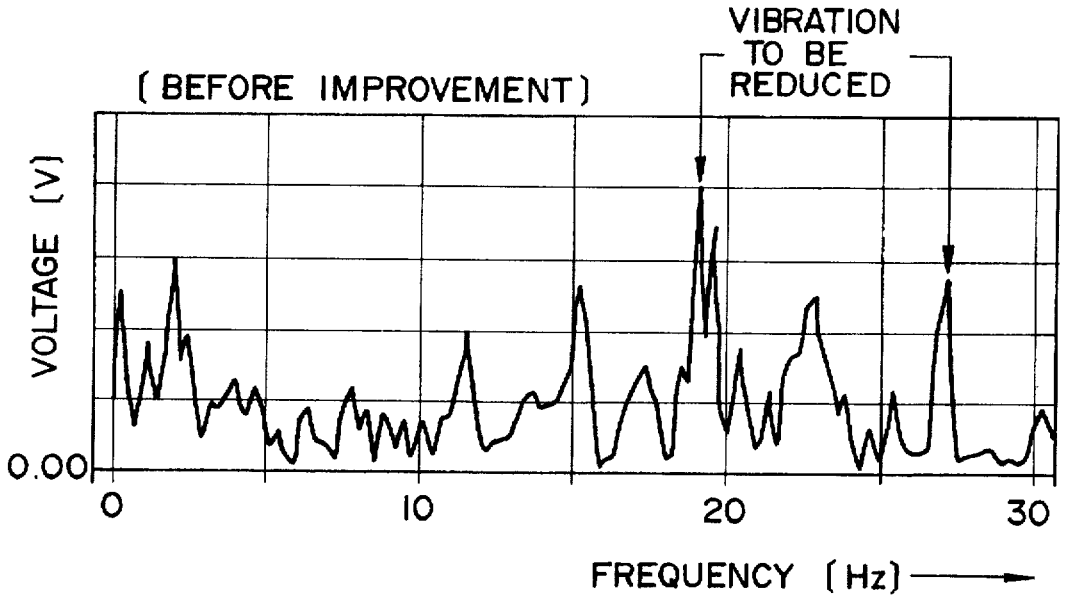
FIGS. 10A and 10B are graphs showing the output voltages of an acceleration pick-up meter and associated with the timing pulleys of FIGS. 9A and 9B, respectively.
Figure 10B:
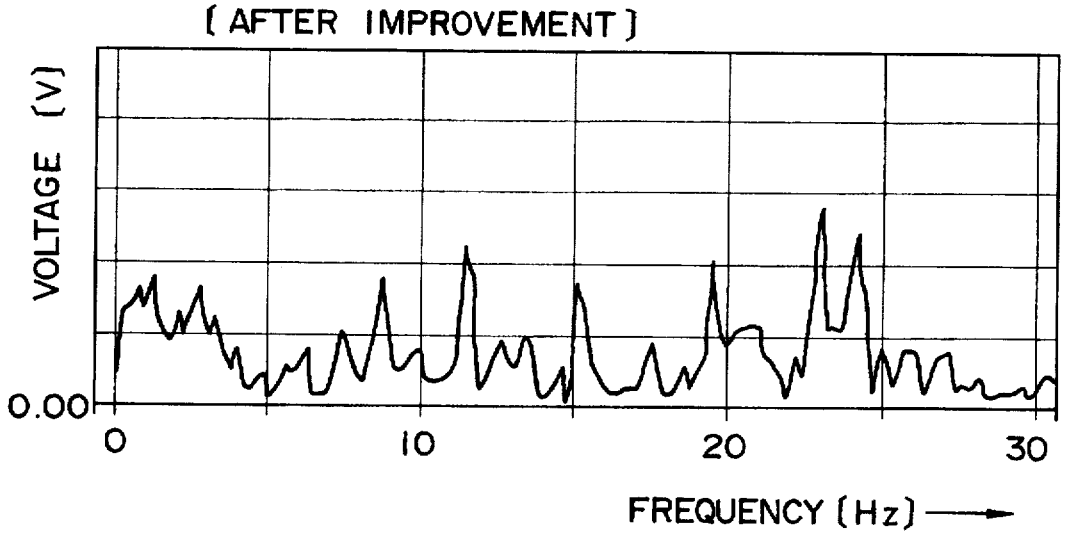

FIGS. 10A and 10B show the output voltages of an acceleration pick-up meter mounted on the casing 49 supporting the drive roller 202. FIG. 10A shows the voltages associated with the pulley 46 formed of plastics while FIG. 10B shows the voltage associated with the pulley 46 formed of sintered metal. As shown, in a low frequency range below 30 Hz, vibration is lower with the metal pulley 46 having great rotary motion energy than with the plastics pulley 46. Particularly, high vibration peaks at and around the frequencies of 19 Hz and 27 Hz are noticeably reduced by the metal pulley 46.

3rd Embodiment

Figure 11:
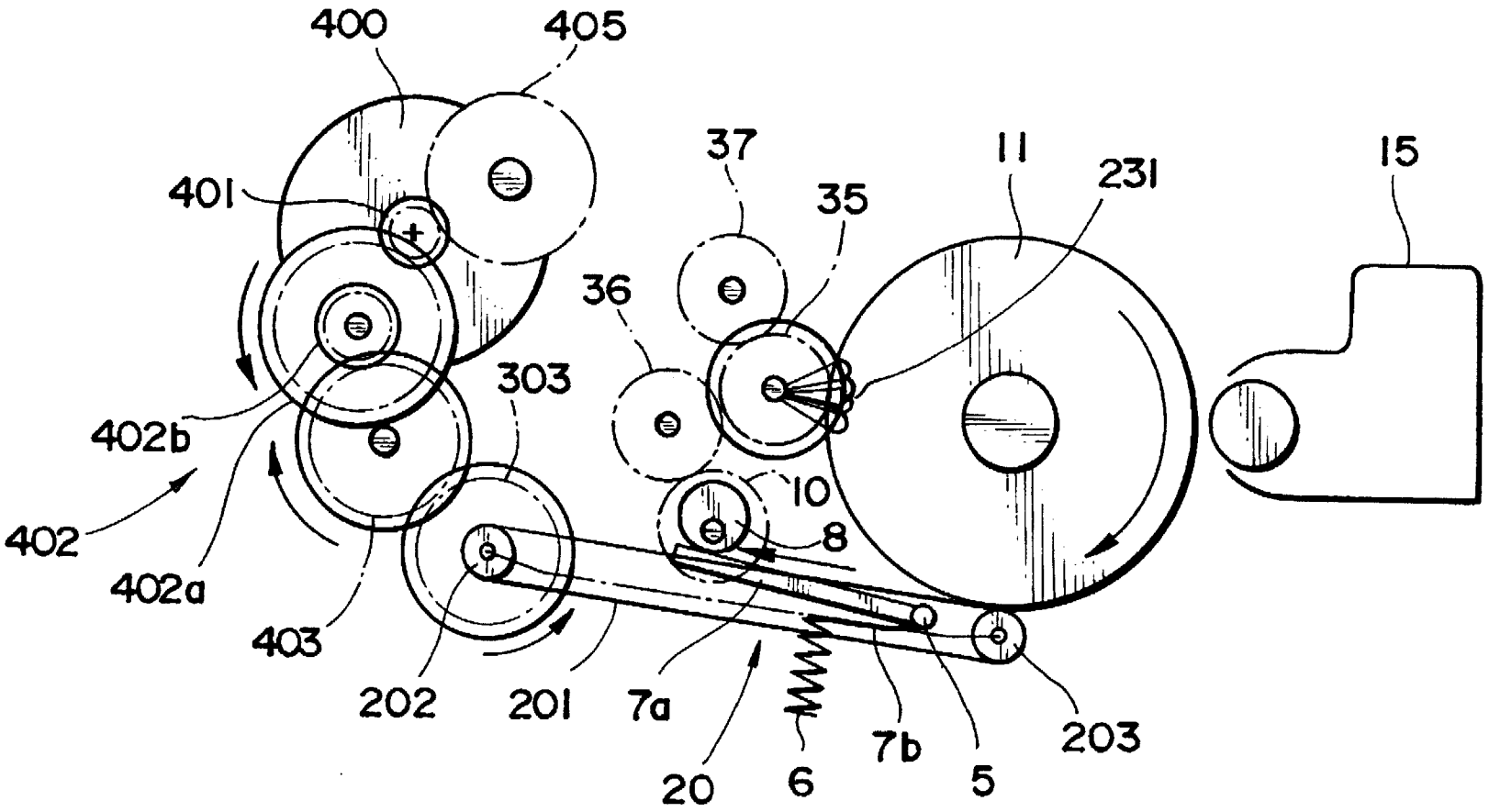
FIG. 11 is a side elevation of a drive line representative of a third embodiment of the present invention.

FIG. 11 shows a belt drive line representative of a third embodiment of the present invention and also applied to the copier of FIG. 1. As shown, two speed reduction gears 405 and 402 are held in mesh with the motor pinion gear 401. The reduction gear 405 transmits torque to the developing device 15 and cleaning brush 231. The reduction gear 402 is made up of a large diameter gear **402*a* meshing with the pinion gear 401, and a small diameter gear 402*b* coaxial with the gear 402*a* and meshing with the gear 403. The reduction gear 402 transmits torque to the drive gear 303 coaxial with the drive roller 202 via the gear 403, thereby rotating the belt 201**.

The gear 10 is affixed to the input shaft of the half-rotation electromagnetic spring clutch, as stated earlier. The gear 405 transmits the torque to the gear 10 by way of an idler gear 36, a cleaning brush drive gear 35, an idler gear 37 (for driving the developing device 15), and a timing belt or a gear, not shown. Because the gear 10 is not connected to the drive gear 303, the vibration (impact) ascribable to the repeated coupling and uncoupling of the spring clutch is not transferred to the drive gear 303.

All the gears shown in FIG. 11 are formed of resin each having a small modulus of elasticity (more elastic than a gear made of metal). The vibration ascribable to the coupling and uncoupling of the spring clutch is transferred from the gear 10 to the gears 36, 37 and 405, but sparingly transferred to the gear 303 via the gears 401, 402 and 403; that is, while the vibration is routed through the number of resin gears, it is absorbed by the elastic deformation of the roots of the gear teeth.

Further, vibration ascribable to the moment of inertia of a rotor included in the motor 400 and transferred from the gear 10 to the gear 405 is reduced by the pinion gear 401. Only the pinion gear 401 is made of metal (S45C).

Figure 12A:
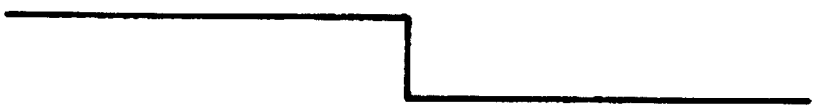
FIGS. 12A–12C are charts showing how the rotation speed of a photoconductive drum varies in association with the ON/OFF timing of a transfer belt clutch included in the drive line of FIG. 11.
Figure 12B:
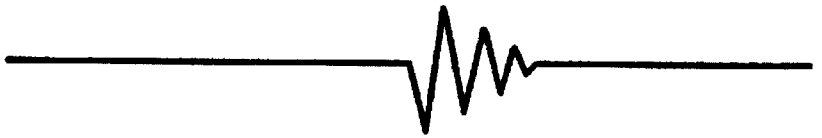
Figure 12C:
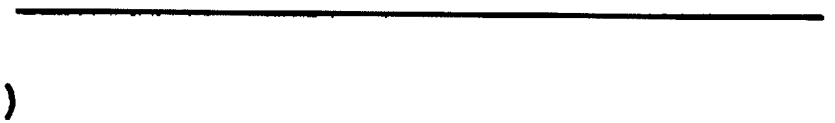

FIG. 12A shows the ON-OFF timing of the half rotation spring clutch. FIGS. 12B and 12C respectively show the variation in the rotation speed of the drum 11 to occur when the vibration ascribable to the clutch is transferred from the drive gear 303 to the idler gear 9 (FIGS. 4 and 5), and the variation to occur when it is not routed through the drive gear 303 (FIG. 11).

As stated above, the embodiment drives each of the drive gear 303 and the gear 10 of the half-rotation clutch by the respective gear train. This prevents the vibration (impact) ascribable to the coupling and uncoupling of the clutch from being transferred to the drive gear 303 and thereby frees the belt 201 from vibration. As a result, an image being written to the drum 11 is free from disturbance otherwise caused by the variation in the speed of the drum 11.

4th Embodiment

Figure 13:
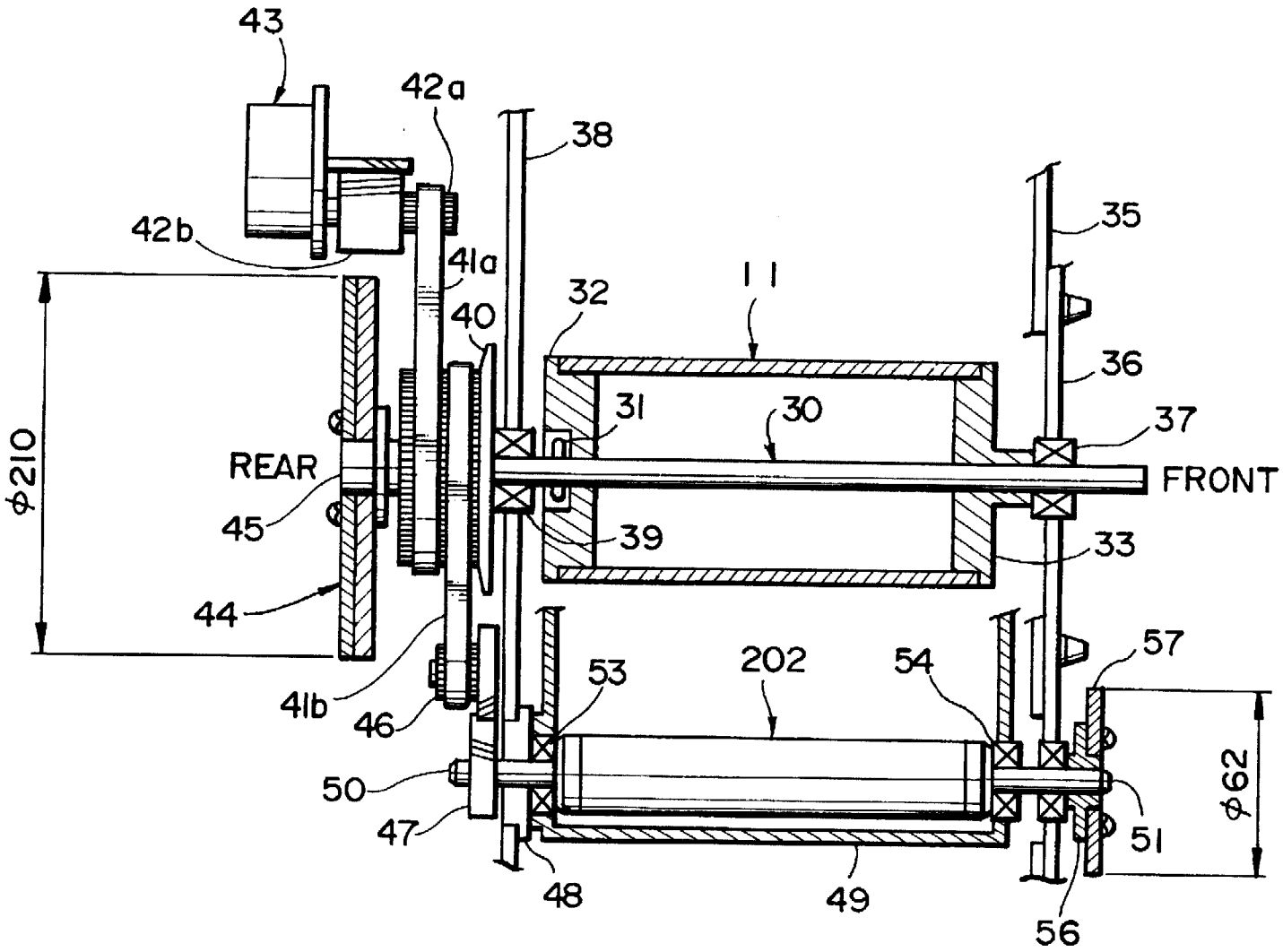
FIGS. 13 and 14 are sections showing drive lines respectively representative of a fourth and a fifth embodiment of the present invention.

FIG. 13 shows a belt drive line representative of a fourth embodiment of the present invention and also applied to the copier shown in FIG. 1. As shown, a flange 56 is fastened to the shaft 51 by set screws each having a hexagonal hole. A flywheel 57 is affixed to the flange 56 by set screws. The rest of the construction is identical with the second embodiment. The flywheel 57 has a moment of inertia J of 0.33 kg·cm$^2$ (thickness t of 2.9 mm, diameter of 62 mm, and inside diameter of 8 mm). The ratio of the fly wheel 57 to the flywheel 44 of the drive roller 202 as to rotary motion energy is produced by:

$$[\tfrac{1}{2}J(\text{flywheel 57})\omega^2]/[\tfrac{1}{2}J(\textit{flywheel 44})\omega^2]\times 100=19\%$$

The flywheel 57 therefore can have rotary motion energy which is about 20% of the energy of the flywheel 44. This is also successful to reduce the vibration of the drive roller 202.

5th Embodiment

Figure 14:
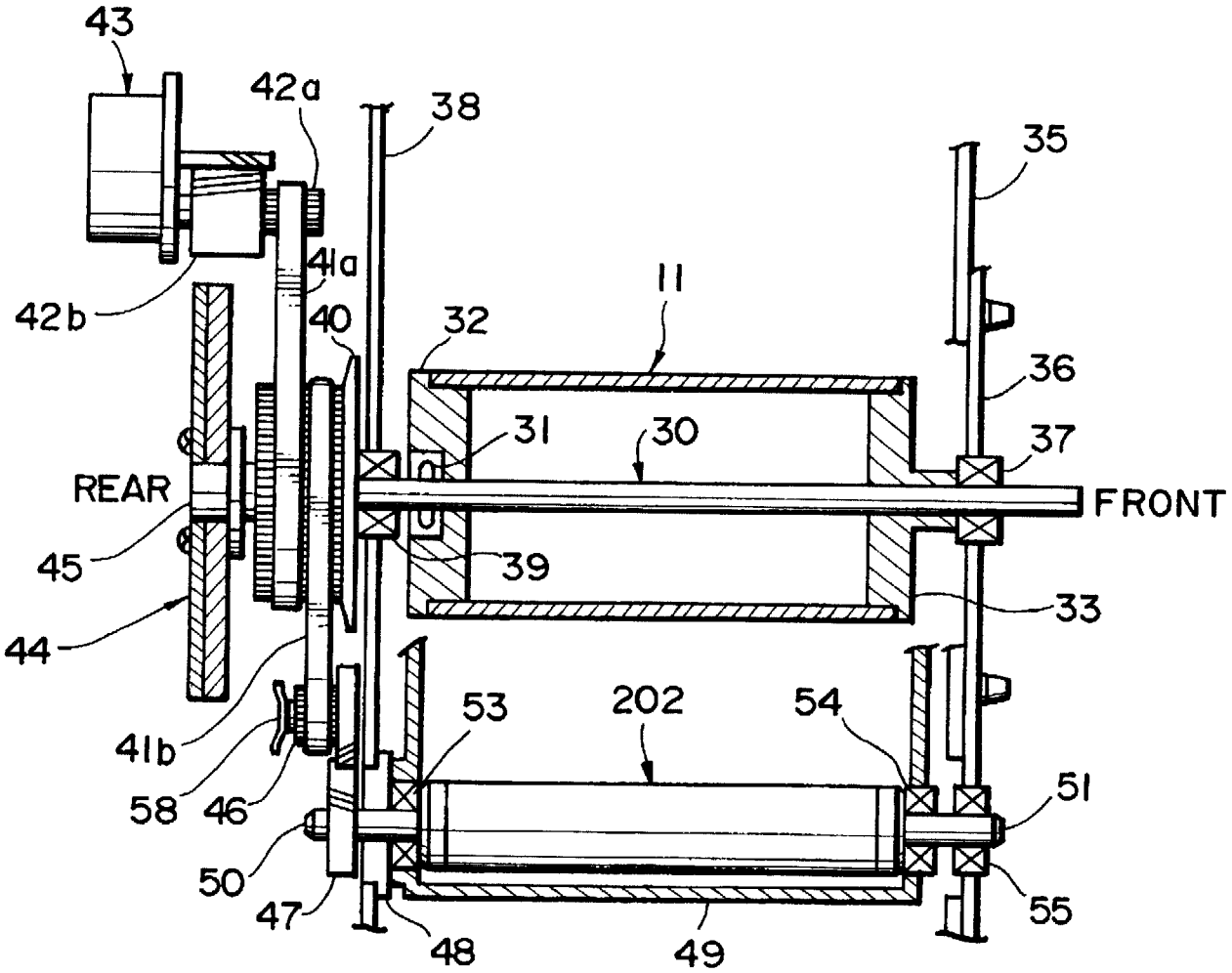
Figure 15:
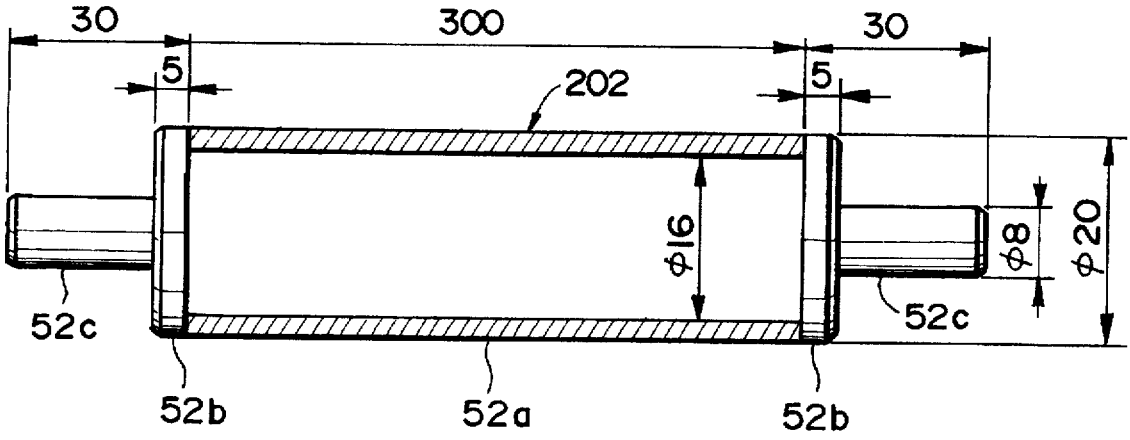
FIG. 15 is a section showing a drive roller included in the fifth embodiment.

FIG. 14 shows a belt drive line representative of a fifth embodiment of the present invention and also applied to the copier of FIG. 1. As shown, a flywheel 58 is affixed to the timing pulley 46 by heat caulking. The drive roller 202 and timing pulley 46 is shown in detail in FIGS. 15 and 16, respectively. As shown in FIG. 15, the drive roller 202 is implemented as a hollow metallic cylinder **52*a* affixed to opposite end plates 52*b* each having a shaft 52*c***. The rest of the construction is identical with the second embodiment.

The metallic cylinder **52*a* has a specific gravity $\rho=7.9\times|1/10^3|$ kg·cm$^2$. The end plates 52*b* and shafts 52*c* are formed of the same material as the cylinder 52***a* and have the same specific gravity as the cylinder 52*a*. The cylinder 52*a* has a moment of inertia Ja produced by:

$$Ja=\frac{1}{2}\pi\cdot 7.9\times|1/10^3|\times 300\times|1/10^1|\cdot(1^4-0.8^4)=0.22\ \text{kg}\cdot\text{cm}^2$$

The end plates 52*b* each has a moment of inertia Jb produced by:

$$Jb=\frac{1}{2}\pi\cdot 7.9\times|1/10^3|\times 5\times|1/10^1|\cdot 1^4=0.006\ \text{kg}\cdot\text{cm}^2$$

The shafts 52*c* each has a moment of inertia Jc produced by:

$$Jc=\frac{1}{2}\pi\cdot 7.9\times|1/10^3|\times 25\times|1/10^1|\cdot 0.4^4=0.0008\ \text{kg}\cdot\text{cm}^2$$

Therefore, the drive roller 202 has a total moment of inertia Jα produced by:

$$J\alpha=0.22+0.006\times 2+0.0008\times 2=0.23\ \text{kg}\cdot\text{cm}^2$$

The driven roller 203 (FIG. 1) is another roller existing in the image transfer unit 20 and substantially identical in specifications with the drive roller 202. The two rollers in the image transfer unit 20 have a total moment of inertia Jto produced by:

$$Jt=0.23\times 2=0.46\ \text{kg}\cdot\text{cm}^2$$

Figure 16:
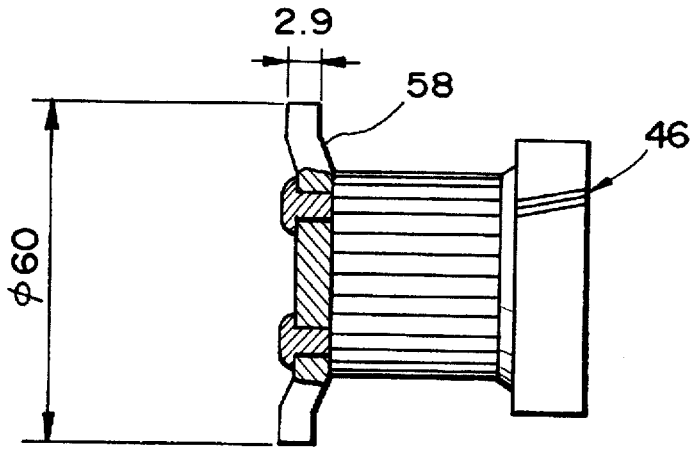
FIG. 16 is a side elevation showing a timing pulley also included in the fifth embodiment.

The timing pulley 46 and gear 47 meshing with the gear portion of the pulley 46 are made of resin and assumed to have substantially the same moment of inertia. The flywheel 58 is affixed to the pulley 46 by heat caulking (FIGS. 14 and 16). Assume that the flywheel 58 is a disk having a moment of inertia J58, a diameter of 60 mm, and a thickness t of 2.9 mm, neglecting the shrinkage, hole, etc. Then, J58 and Jto are produced by:

$$\begin{aligned} J58 &= 1/2\pi\cdot 7.9\times 2.9\times|1/10^3|\times|1/10^1|\cdot 3^4 \\ &= 0.29\ \text{kg}\cdot\text{cm}^2 \\ Jto &= 0.66\ \text{kg}\cdot\text{cm}^2 > J58 = 0.29\ \text{kg}\cdot\text{cm}^2 \end{aligned}$$

The rollers 202 and 203 of the image transfer unit 20 have a greater moment of inertia than the flywheel 58. However, it is possible to increase the rotary motion energy of the timing pulley 46 side (driving side) by increasing the rotation speed of the gear of the pulley 46 meshing with the driven gear 47. If the rotation speed of the driven gear 47 is 200 rpm, then the rotation speed ω of the timing pulley 46 is 252 rpm based on the relation of $0.92\omega^2>0.46200^2$. It follows that if the rotation speed of the gear of the pulley 46 is 252 rpm or above, then the rotation energy of the driving side (46) is greater than that of the driven side (20) as to the image transfer unit 20. This allows the variation in the speed of the belt 201 to be minimized; that is, the variation can be reduced with a relatively small flywheel 58.

Various modifications will become possible for those skilled in the art after receiving the teachings of the present disclosure without departing from the scope thereof. For example, the belt 201 for image transfer may be replaced with a roller. Likewise, the first sad second chargers 13 and 16 may each be implemented as a charge roller or a charge belt contacting the drum 11.

What is claimed is:

1. An image forming apparatus comprising:

an image carrier for forming an image thereon;

a first motor for causing said image carrier to rotate;

contact type charging means for charging said image carrier in contact therewith;

a driven gear for causing said charging means to rotate;

a drive gear for causing said driven gear to rotate in direct or indirect mesh therewith; and a second motor independent of said first motor and for driving said charging means.

2. An apparatus as claimed in claim 1, wherein said charging means comprises at least one of a charge roller, a charge belt, an image transfer roller, and an image transfer belt.

3. An image forming apparatus comprising:

an image carrier;

image forming means for forming a toner image on said image carrier;

medium feeding means for feeding a recording medium to said image carrier;

contact type charging means for transferring the toner image from said image carrier to the recording medium;

conveying means for conveying the recording medium carrying the toner image thereon;

a first motor for driving said medium feeding means and said conveying means; and a second motor independent of said first motor and for causing said image carrier and said charging means to rotate.

4. An apparatus as claimed in claim 3, further comprising:

a first driven gear affixed to a shaft of said image carrier, and caused to rotate by said second motor;

a flywheel caused to rotate by said first driven gear; and a second driven gear affixed to a shaft of said charging means, and caused to rotate by said shaft of said image carrier.

5. An apparatus as claimed in claim 3, wherein said charging means comprises at least one of a charge roller, a charge belt, an image transfer roller, and an image transfer belt.

6. An image forming apparatus comprising:

an image carrier;

a motor for causing said image carrier to rotate;

contact type charging means for charging said image carrier by selectively contacting said image carrier;

moving means for moving said charging means between an operative position where said charging means contacts said image carrier and an inoperative position where said charging means does not contact said image carrier;

a drive transmission line including a first driven gear for causing said charging means to rotate, and a first drive gear for causing said driven gear to rotate in direct or indirect mesh with said driven gear; and a clutch drive line including a second driven gear for causing said moving means to rotate, and a second drive gear for causing said second driven gear to rotate in direct or indirect mesh with said second driven gear.

7. An apparatus as claimed in claim 6, wherein said charging means comprises at least one of a charge roller, a charge belt, an image transfer roller, and an image transfer belt.

8. A device for driving a contact type charging member which charges an image carrier of an image forming apparatus in contact with said image carrier, said device comprising:

a driven gear for causing the charging member to rotate;

a drive gear for causing said driven gear to rotate in direct or indirect mesh therewith; and drive means for causing said drive gear to rotate;

wherein said drive gear and said driven gear are formed of metal and resin, respectively.

9. A device for driving a contact type charging member which charges an image carrier of an image forming apparatus in contact with said image carrier, said device comprising:

a drive roller for causing the charging member to rotate;

drive means for causing a gear affixed to said drive roller to rotate; and a flywheel mounted on an end of said drive roller, whereby a driving side has greater rotation energy than a driven roller side.

10. A device for driving a contact type charging member which charges an image carrier of an image forming apparatus in contact with said image carrier, said device comprising:

a driven gear for causing said charging member to rotate;

a drive gear for causing said driven gear to rotate in direct or indirect mesh therewith;

drive means for causing said drive gear to rotate; and a flywheel mounted on said drive gear.

* * * * *